US005697422A

United States Patent [19]

Righi et al.

[11] Patent Number: 5,697,422

[45] Date of Patent: Dec. 16, 1997

[54] APPARATUS AND METHOD FOR COLD CHAMBER DIE-CASTING OF METAL PARTS WITH REDUCED POROSITY

[75] Inventors: Jamal Righi, Murrysville; James R. Fields, Export; Eric D. Arndt, New Kensington, all of Pa.

[73] Assignee: Aluminum Company of America, Pittsburgh, Pa.

[21] Appl. No.: 238,465

[22] Filed: May 5, 1994

[51] Int. Cl.[6] ..... B22C 9/08; B22D 18/02; B22D 27/11

[52] U.S. Cl. ..... 164/120; 164/319; 164/360

[58] Field of Search ..... 164/113, 120, 164/312, 319, 360

[56] References Cited

U.S. PATENT DOCUMENTS

| | | | |
|---|---|---|---|
| 2,785,448 | 3/1957 | Hodler . | |
| 2,932,865 | 4/1960 | Bauer . | |
| 3,008,202 | 11/1961 | Bauer . | |
| 3,270,383 | 9/1966 | Hall et al. . | |
| 3,344,848 | 10/1967 | Hall et al. | 164/312 |
| 3,685,572 | 8/1972 | Carver et al. | 164/312 |
| 3,901,306 | 8/1975 | Miki et al. | 164/312 |
| 4,059,143 | 11/1977 | Morita et al. | 164/113 |
| 4,955,426 | 9/1990 | Akimoto et al. | 164/312 |
| 4,997,027 | 3/1991 | Akimoto | 164/312 |

FOREIGN PATENT DOCUMENTS

| | | | |
|---|---|---|---|
| 3044992 | 6/1982 | Germany | 164/312 |
| 49-21011 | 5/1974 | Japan | 164/312 |
| 1-118354 | 5/1982 | Japan | 164/312 |

*Primary Examiner*—Kuang Y. Lin

*Attorney, Agent, or Firm*—Richard V. Westerhoff; Thomas R. Trempus

[57] ABSTRACT

A vacuum die-casting machine has a sprue cavity with sufficient depth facing the shot cylinder that the shot cylinder piston can easily crush with a pressure of less than 1000 psi the thin cylindrical shell of solidified metal which develops into the biscuit, and continue to advance after the die cavity becomes fried with molten metal to inject additional molten metal into the die cavity to make up for shrinkage porosity as the cast part cools. The runner through which the molten metal passes from the sprue cavity into the die cavity has generally spherical reservoirs adjacent circular gates to further assure the supply of the additional molten metal to make up for shrinkage in the part. In addition, the piston can be oil cooled steel to delay formation of the biscuit.

13 Claims, 6 Drawing Sheets

APPARATUS AND METHOD FOR COLD CHAMBER DIE-CASTING OF METAL PARTS WITH REDUCED POROSITY

BACKGROUND OF THE INVENTION

1. Field of the Invention

This invention relates to cold chamber die-casting of metal parts and particularly to apparatus and a method for intensification of the casting to reduce porosity through arrangements which permit sufficient travel of the piston after the die cavity is filled to make up for shrinkage during solidification.

2. Background of Information

In cold chamber vacural die-casting, molten alloy is syphoned into the shot cylinder and subsequently driven into the die cavity by a water-cooled piston. Piston pressures in the range of 10,000 to 15,000 psi are typically applied to the alloy in order to feed the shrinkage porosity as the casting solidifies. In this process, significant alloy solidification occurs on the surface of the much cooler piston. The solidified alloy shell prevents the movement of the piston in a very short period (less than one second) and leads to poor intensification of the part being die-cast. Poor intensification can produce porosity defects in the part, especially in the thicker sections of die-castings.

There is a need therefore for an improved apparatus and method for cold chamber die-casting which produces quality castings with less porosity than is presently achievable. There is a related need for such an improved apparatus and method which permits the piston to travel a sufficient distance during intensification to make up for solidification porosity.

SUMMARY OF THE INVENTION

We have found that a cylindrical shell of solidified alloy develops between the biscuit which forms on the piston and the sprue cavity of the die which communicates with a runner delivering molten alloy to the die cavity through a gate. In current cold chamber die-casting machines the solidified cylindrical shell is a short thick column that is structurally supported at the base of the biscuit and offers the most resistance to movement of the piston during intensification. The present invention includes moving the structural support base of the solidifying alloy farther away from the advancing piston. This is achieved in part by increasing the depth of the sprue cavity which essentially increases the thickness of the biscuit. This results in a thinner and longer shell of solidified alloy which can be crushed by the moving piston. The increase in the biscuit thickness provides more space to collapse or buckle the formed alloy shell and hence allows longer piston travel which prolongs the intensification; and therefore reduces the porosity of the die-cast part.

As another aspect of the invention, a reservoir for the molten metal is formed in the runner adjacent the gate leading to the die cavity. This reservoir stores sufficient molten alloy for make-up of shrinkage in the part before the runner solidifies. Preferably, the reservoir is generally spherical, as such a configuration offers the lowest surface area for heat loss thereby increasing the duration in which molten alloy is available for make-up of shrinkage.

With the invention, the pressure which must be generated by the piston for intensification is significantly reduced, from about 10,000 to 15,000 psi to below 5,000 psi and even below 1,000 psi. This also reduces the structural requirements of the die-casting apparatus. As yet another aspect of the invention, the piston is provided with a convex working surface and the confronting wall of the sprue cavity has a complimentary concave wall surface to reduce damage to the die should the piston over travel. In addition, the typical copper alloy piston can be replaced by a steel piston. The steel piston is cooled as is the copper piston but may be maintained at a higher temperature to further prolong movement of the piston for intensification.

More particularly, the invention in a broad sense is directed to cold chamber die-casting apparatus for casting metal parts, said apparatus comprising:

die means comprising a fixed die part and a movable die part defining between them a die cavity in which said part is formed;

a shot cylinder connected to said fixed die part and having a shot sleeve bore of a preselected diameter in which a charge of molten metal is received; said die means also defining a sprue cavity communicating with said shot cylinder bore and a runner connecting said sprue cavity to said die cavity;

a piston reciprocally slidable in said shot cylinder bore; and means advancing said piston in said shot cylinder bore to inject said charge of molten metal through said sprue cavity and runner into said die cavity to fill said die cavity; said sprue cavity having a diameter and a depth sufficient to allow said piston to continue advancing after said die cavity is filled with said molten metal by a distance which injects additional molten metal into said die cavity to make up for any shrinkage of said part during solidification.

Also in a broad sense the invention is directed to a method of casting parts from metal in a cold-chamber die-casting machine having a shot cylinder with a piston which injects a charge of molten metal through a sprue cavity and a runner to fill a die cavity to form said part, said method comprising the steps of:

sizing said sprue cavity to a diameter substantially equal to and generally concentric with said shot cylinder and a depth in front of said shot cylinder such that after said piston is advanced to inject molten metal to fill said die cavity said piston is advanced farther toward said sprue to inject additional molten metal into said die cavity to make up for shrinkage of molten metal during solidification.

BRIEF DESCRIPTION OF THE DRAWINGS

A full understanding of the invention can be gained from the following description of the preferred embodiments when read in conjunction with the accompanying drawing in which.

DESCRIPTION OF THE PREFERRED EMBODIMENT

The invention will be described as applied to die-casting an aluminum alloy yoke. This is for illustrative purposes only, and those skilled in the art will realize that the invention is applicable to making any kind of die-cast part using a variety of metals or alloys. The yoke is particularly suitable for illustrating the invention, as it has very thin parts and other relatively thick parts. It is the thick parts that are particularly subject to shrinkage porosity.

Figure 1:
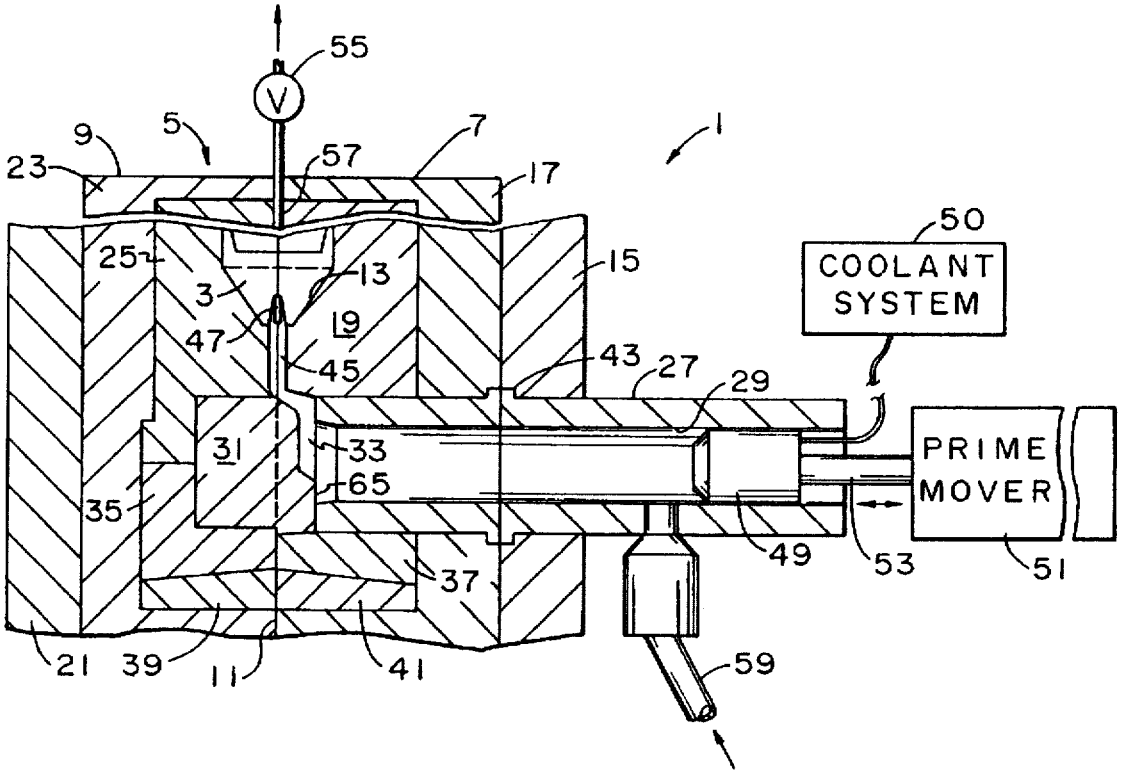
FIG. 1 (PRIOR ART)
FIG. 1 is a vertical sectional view through a portion of a cold chamber vacuum die-casting machine in accordance with the prior art shown ready for receiving a charge of molten metal.

FIG. 1 illustrates a conventional cold chamber vacural die-casting machine 1 for casting a part 3, such as the yoke mentioned above. The die-casting machine 1 includes a die 5 having a fixed or cover die half 7 and a movable die half 9 which form at their parting line 11 a die cavity 13. The fixed die half 7 includes a fixed platen 15 which supports a fixed die holder block 17. A fixed die insert 19 mounted in a recess in the fixed die holder block 17 defines the fixed half of the die cavity 13. The movable die half 9 includes a movable platen 21 carrying a movable die holder block 23 in which the movable die insert 25 forming the movable half of the die cavity 13 is supported.

A shot cylinder 27 having a bore 29 extends into the fixed die half 7. A sprue 31 projecting from the movable die half 9 across the parting line 11, has a sprue cavity 33 which communicates with the shot cylinder bore 29. The sprue 31 is supported in the movable die holder block 23 by an ejector shot patch 35, while a cover die shot patch 37 fixes the shot cylinder 27 in the fixed die half 7. An ejector wedge 39 and cover die wedge 41 lock the parts in the movable die holder block 23 and fixed die holder block 17, respectively. An annular shoulder 43 on the shot cylinder 27 transmits the forces generated in the molten metal during injection and intensification to the fixed platen 15.

A runner 45 extends from the sprue cavity 33 to the die cavity 13. A gate 47 at the outlet of the runner 45 restricts flow so that molten metal is injected into the die cavity 13 at high velocity. A piston 49 is reciprocated in the shot cylinder bore 29 by a prime mover 51 such as a hydraulic ram through a piston rod 53. The piston 49 is cooled by circulation of a coolant supplied by a coolant system 54 through the piston 49. A vacuum source 55 evacuates through a vacuum line 57 the die cavity 13, the runner 45, the sprue cavity 33 and the shot cylinder bore 29, and draws a charge of molten metal from a holding vessel (not shown) into the shot sleeve bore 29 through a siphon tube 59. The piston 49 is advanced in three phases, initially at a slow speed to fill the shot cylinder bore 29 and sprue cavity 33, as the charge initially fills the shot cylinder only partially. The speed of the piston 49 is then increased during a second phase to inject the molten metal into the runner 45 and die cavity 13. A third phase begins when the die cavity is fried with molten metal and begins to solidify. Solidification results in shrinkage porosity in the metal in the die, especially in the thicker sections of the part 3. The piston 49 continues to advance, but at a slower rate, to inject additional molten metal to make up for the shrinkage. However, in the current die casting apparatus, the piston is stopped in a very short time, less than one second. Very high pressures, in the range of 10,000 to 15,000 psi, are then applied to the piston in an attempt to supply additional molten metal to make up for shrinkage porosity. As mentioned above, this is accomplished with limited success.

Figure 5:
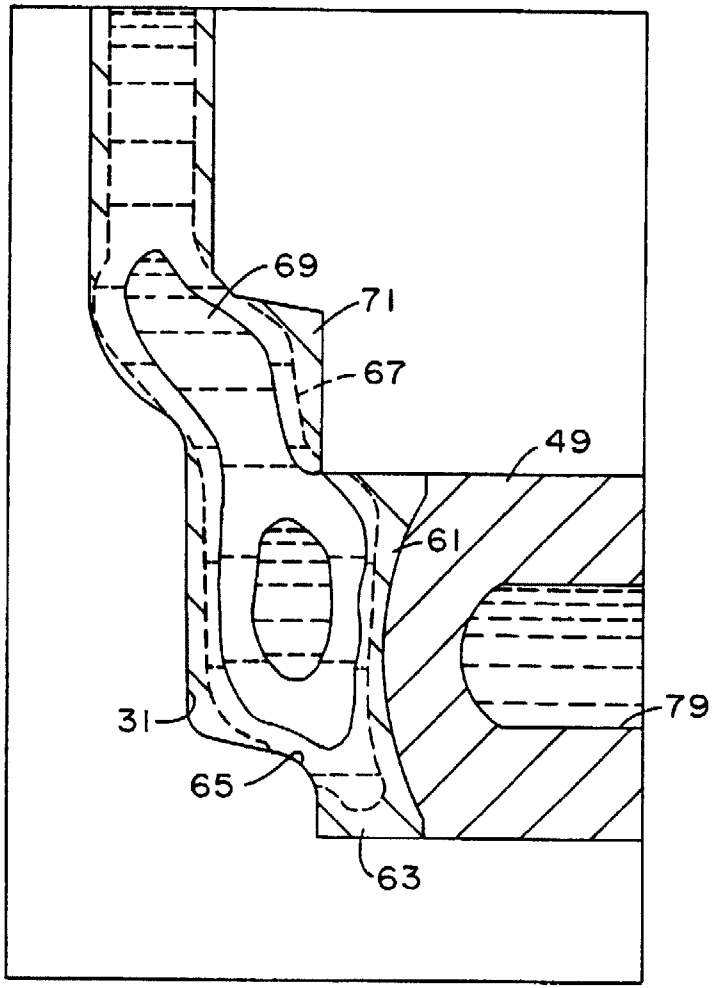
FIG. 5 is a schematic vertical section through the prior art apparatus of FIG. 1 illustrating casting metal temperature contours in the runner and biscuit two seconds after shot injection.

We have determined through thermal modelling that the problem arises from the fact that the piston is stopped and the runner solidifies before the thicker sections of the cast part have solidified, so that it is not possible to inject the required additional metal needed to make up for the porosity which develops when the thicker sections of the cast part finally solidify. More particularly, we found the manner in which the biscuit is formed in the end of the shot cylinder results in the rapid stalling of the piston. This can be understood more easily from reference to the FIGS. 1A, 1B and 5. The biscuit 61 is the circular section of alloy which remains in the end of the shot sleeve following injection of the metal into the die. This biscuit 61 forms as a thin cylindrical shell 63 which rapidly grows inward. This is due in part to the use of a copper alloy for the piston 49 which is water cooled, typically to a temperature of about 90° C. This cooling increases the production rate by solidifying the alloy more rapidly. However, this rapid solidification is also what hinders intensification of the cast part. The problem is compounded by the shoulder 65 conventionally provided on the sprue 31 in the prior art die casting machines. FIG. 5 is a thermal model of the runner which forms in the prior art machines. The dashed line 67 identifies the transition between the liquid phase 69 and the solid phase 71 of the casting alloy. As can be seen in FIG. 5 a short, thick shell 63 is formed in the prior art die casting machine in a very short time. This thick shell stalls movement of the piston 49 even though there is still liquid alloy 69 in the runner. While FIG. 5 models conditions two seconds after injection, this shell 63 is rigid enough within 0.2 to 0.3 seconds after the start of the third phase to stall the piston and prevent further intensification resulting in shrinkage defects in the casting.

Another problem with the prior art die casting machinery which we found inhibits intensification, is that alloy 48 in the runner solidifies adjacent to gate 47 preventing further injection of molten metal that may be remaining in the runner into the die cavity 13. The gate 47 is sized to restrict flow in order to generate high injection velocity into the die cavity to assure filling and atomization of the metal stream into the die cavity. However, as mentioned, we have found that the metal solidifies in the area of the gate 47, thereby preventing injection of the additional metal needed for intensification.

Figure 1B:
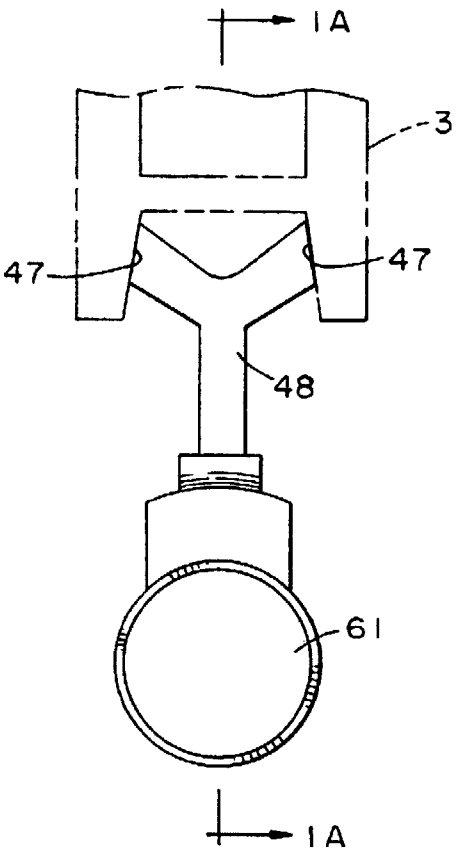
FIG. 1B (PRIOR ART)
FIG. 1B is a vertical sectional view taken along the line 1B—1B in FIG. 1A.
Figure 1A:
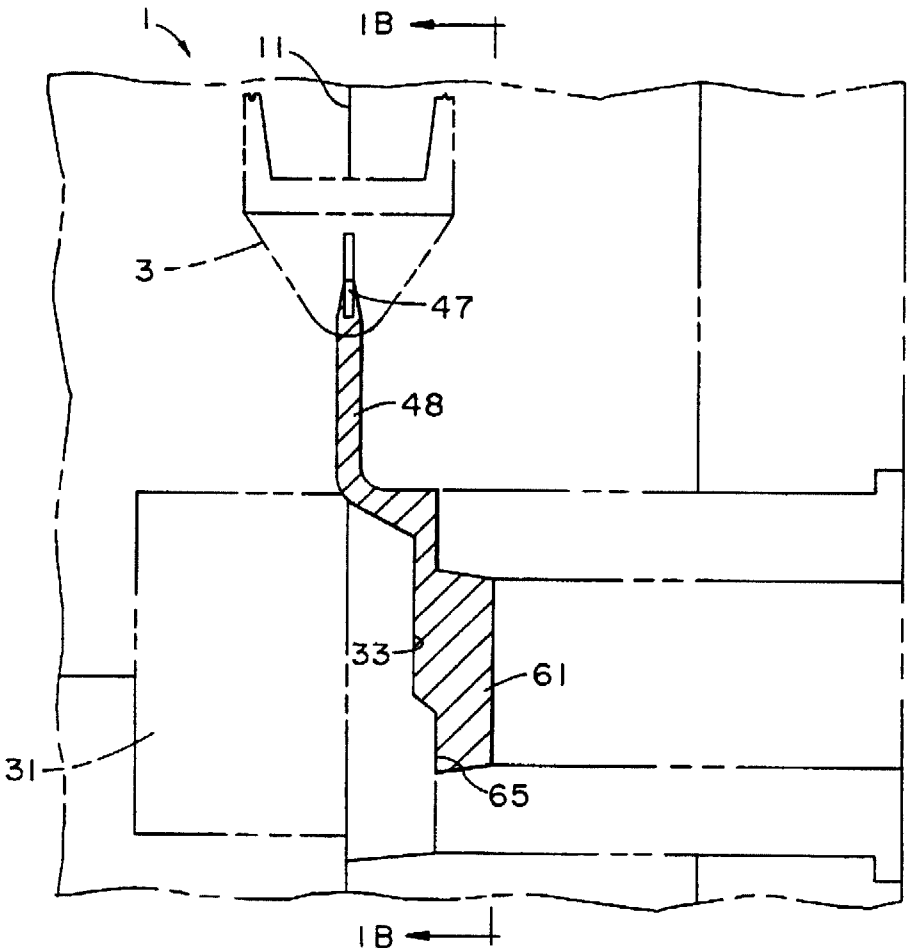
FIG. 1A (PRIOR ART)
FIG. 1A illustrates a portion of FIG. 1 in enlarged scale after the charge of molten metal has been injected into the die.
Figure 2:
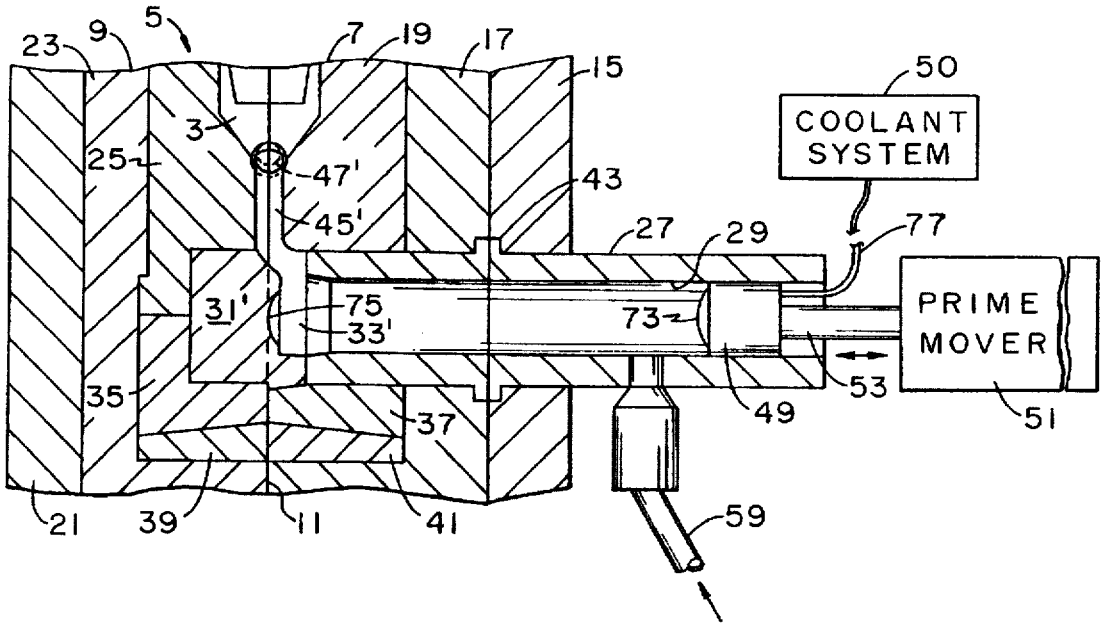
FIG. 2 is a vertical sectional view similar to that of FIG. 1 but through a portion of a cold chamber vacuum die-casting machine in accordance with the present invention, also shown prior to loading of the charge of molten metal.
Figure 2B:
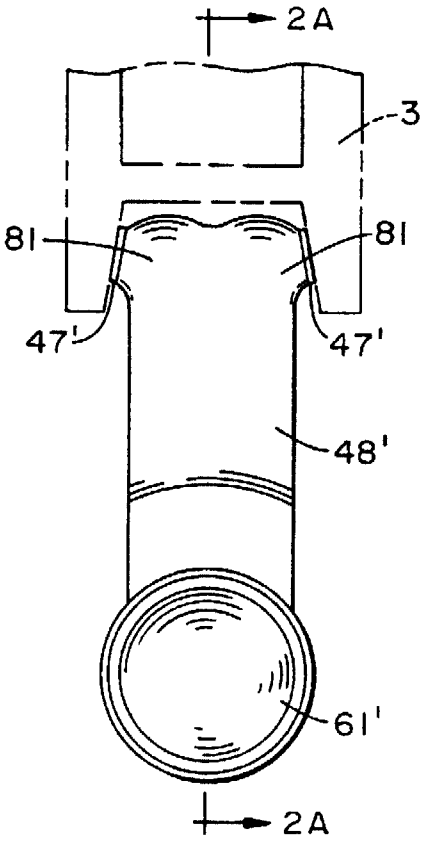
FIG. 2B is a vertical sectional view taken along the irregular surface of the runner illustrated in FIG. 2A and represented by the line 2B—2B.
Figure 2A:
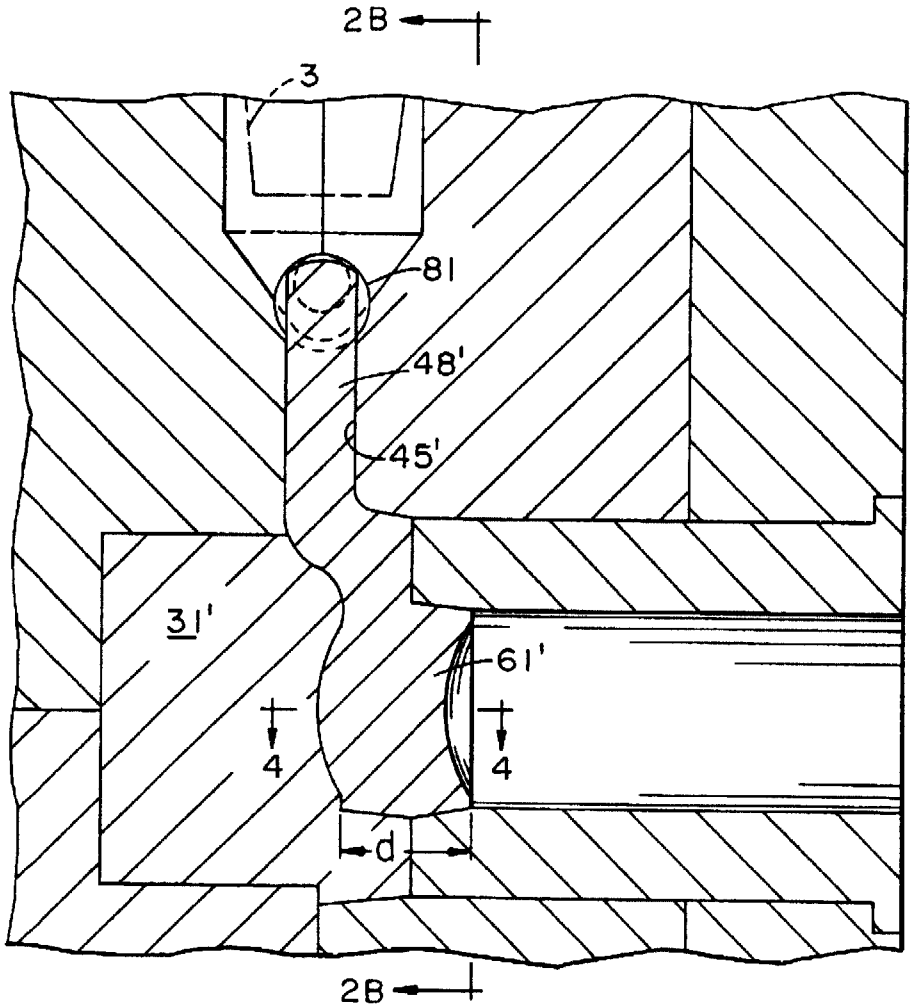
FIG. 2A illustrates a portion of FIG. 2 in enlarged scale after a charge of molten metal has been injected into the die.
Figure 3:
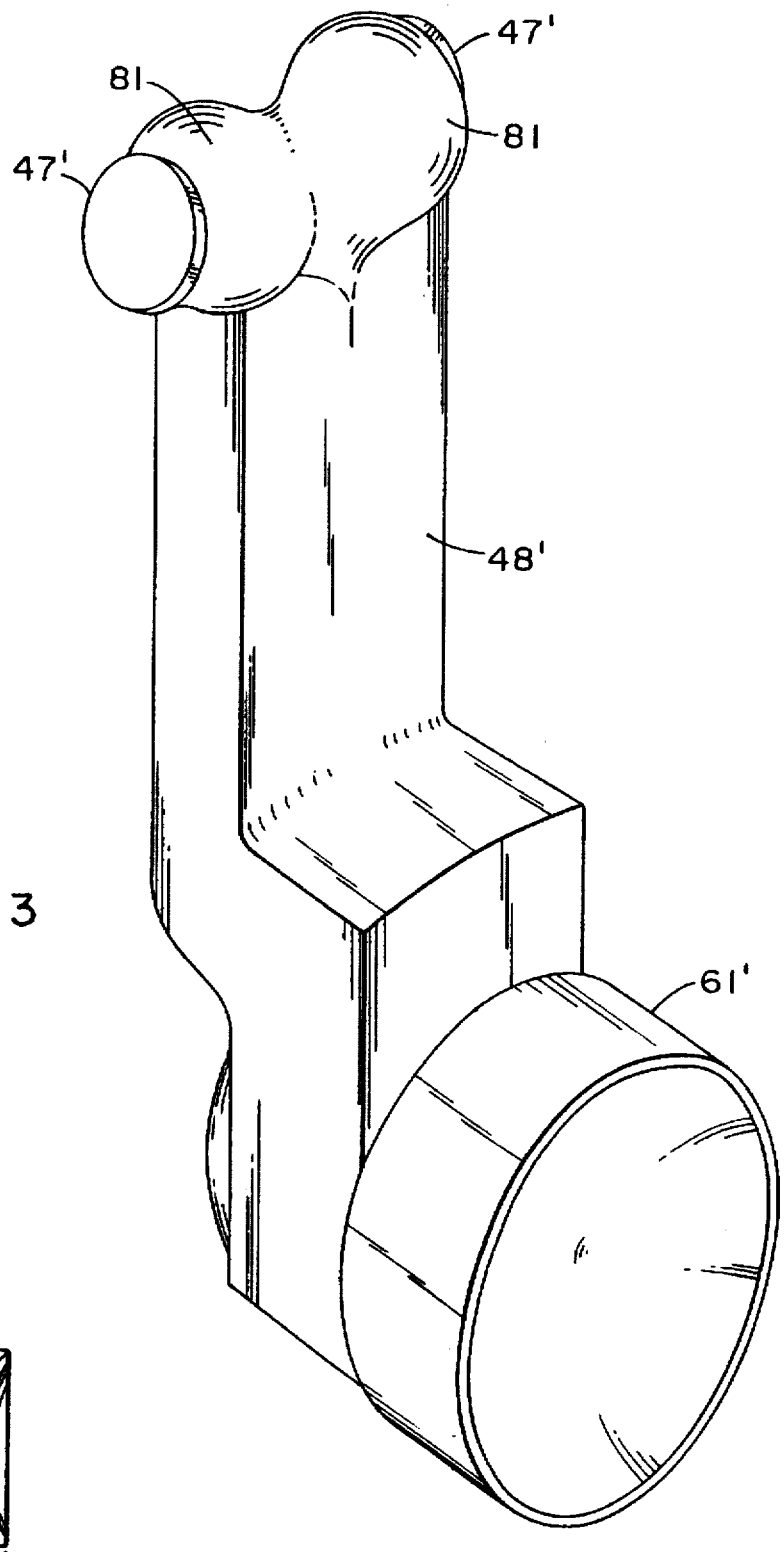
FIG. 3 is a isometric view of the runner including the biscuit formed by vacuum die-casting a part using the apparatus of FIG. 2.
Figure 4:
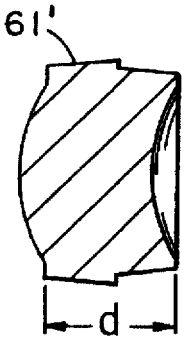
FIG. 4 is a horizonal sectional view through the runner and biscuit taken along the line for 4—4 in FIG. 2A.

We have found that intensification can be improved and that the forces required to do so can be dramatically reduced by certain modifications to conventual vacuum die casting apparatus. These modifications are illustrated in FIGS. 2, 2A, 2B, 3 and 4. In these figures, elements which are the same as those in the apparatus illustrated in FIGS. 1, 1A and 1B are identified by like reference characters, and those which are similar but modified are identified by primed reference characters.

Figure 6:
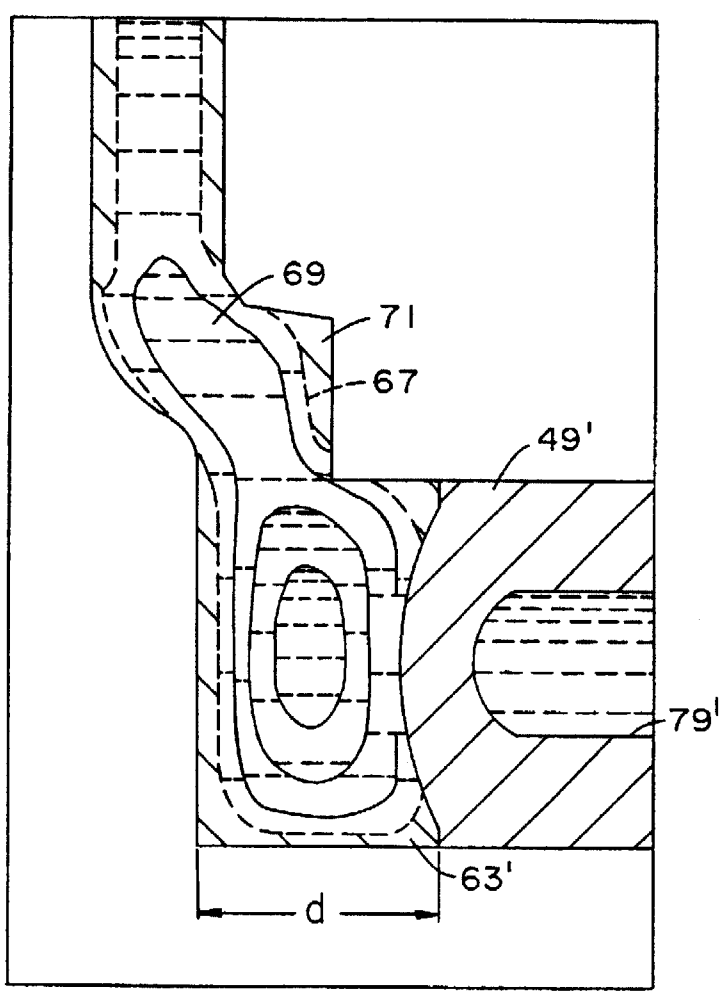
FIG. 6 is a view similar to that of FIG. 5 but taken through the apparatus of the invention illustrated in FIG. 2 and also showing temperature contours of the casting metal two seconds after injection.

As the thermal modelling showed that the biscuit formed as a thick, short shell which stalled piston movement, the sprue 31' was modified to increase the depth of the sprue cavity 33' through elimination of the shoulder 65. This increases the depth d of the cavity 33', which in turn increases the axial length of the shell 63' of solidified metal which forms the periphery of the biscuit. This can be seen in FIG. 6 which illustrates in a manner similar to FIG. 5, the thermal model of the modified apparatus two seconds after injection begins. The axially longer thin shell 63' can be more easily crushed than the thick, short shell 63 which forms in the prior art apparatus. The modified sprue cavity 33' is at least as great in diameter as the bore 29 of the shot sleeve and extends the distance d sufficient to allow the piston to continue travelling after the die cavity 13 becomes filled with metal, by an amount which injects additional molten metal into the die cavity 13 through the runner 45' to make up for shrinkage as the metal in the die 13 solidifies. This is evident from FIGS. 2A and 4. The sprue cavity 33' can have a diameter greater than that of the shot cylinder bore 29 by an amount at least as great is the shell 63' of metal which solidifies on the sprue cavity walls during intensification.

As in the case of the prior art apparatus, the working face 73 of the piston 49 is convex. However, we have provided the rear wall 75 of the sprue 31' with a complementary convex surface so that should the piston over travel, damage to the sprue 31' is minimized.

As was mentioned above, the piston 23 of the prior art machine is made of copper alloy, typically a copper beryllium alloy, and is cooled by a cooling system 54 which circulates water through conduits 77 to passages in the piston 49 shown schematically at 79 in FIG. 5 to cool the piston. This increases the life of the piston and speeds cooling of the runner for higher production rates. Unfortunately, this also contributes to the formation of the thick cylindrical shell 61 of solidified metal adjacent the piston which stalls piston travel and limits intensification. As another aspect of the present invention, the piston 49' is made of a material which can operate at higher temperatures than the copper beryllium pistons currently used. For instance, the piston 49' can be made of AISI H13 steel which may be maintained at a temperature in the range of 260° C. to 500° C. and preferably at a temperature of about 350° C. In this case, the cooling system 54' circulates oil rather than water through the cavities 79' of the piston 49'. The higher operating temperature of the piston 49' slows formation of the cylindrical shell which becomes the biscuit 61'.

In order to prevent premature solidification of metal in the vicinity of the gate 47, we have modified the gate to a circular ,configuration 47' which minimizes the surface area of the stream of injected metal passing through the gate thereby minimizing heat loss as the metal is injected into the die cavity. In addition, we have added a reservoir 81 for molten metal adjacent to the circular gate 47'. In the exemplary apparatus, the part 3 being cast has a pair of spaced apart lugs, and the runner 21' has two oppositely facing gates 47' feeding molten metal into each of the lugs. Reservoirs 81 are provided adjacent to each of the gates 47'. Preferably, these reservoirs 81 are generally spherical in configuration as this minimizes the surface area of the molten metal contained in the reservoir and therefore minimizes heat loss to the surrounding die inserts.

The apparatus of the invention permits the piston 49' to continue travelling after the die cavity has become fried with the casting metal and provides a supply of molten metal adjacent a gate which does not freeze prematurely so that sufficient additional molten metal can be injected into the die cavity 13 to make up for any shrinkage that occurs as the part solidifies. While in the prior art piston movement in the third phase ranged between 0.2 and 0.3 seconds, with our improvements the piston is able to move and push alloy from the biscuit into the casting for as long as 10 seconds piston displacement translates into alloy volume displacement to make up for casting shrinkage. Tests have shown that shrinkage porosity in the lugs of the cast part was reduced from about 0.47% to 0.19% by using the improved gate design with the adjacent reservoirs. The modification to the sprue and piston resulted in a further porosity reduction to 0.05% in the same area of the part. These reductions in porosity were achieved using a force on the piston which resulted in a metal pressure of 600–700 psi in place of the 10,000 to 15,000 psi previously required.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed:

1. Cold chamber die-casting apparatus for casting metal parts, said apparatus comprising:

die means comprising a fixed die part and a movable die part defining between them a die cavity in which said part is formed;

a shot cylinder connected to said die means and having a shot cylinder bore of a preselected diameter in which a charge of molten metal is received; said die means also defining a sprue cavity communicating with said shot cylinder bore and a runner connecting said sprue cavity to said die cavity;

a piston reciprocally slidable in said shot cylinder bore; and means advancing said piston in said shot cylinder bore to inject said charge of molten metal through said sprue cavity and runner into said die cavity to fill said die cavity; said sprue cavity having a diameter and a depth forming a biscuit extending from said shot cylinder bore into said sprue cavity having a volume sufficient such that a solidified cylindrical shell of metal which forms on said biscuit in said shot cylinder bore and said sprue cavity is thin enough to allow said piston to crush said solidified cylindrical shell of metal and to continue advancing after said die cavity is filled with said molten metal by a distance which injects additional molten metal into said die cavity to make up for any shrinkage of said part during solidification and said runner defining a gate at said die cavity sized to restrict flow and generate a high injection velocity within said die cavity, and said runner having adjacent said gate a chamber forming a reservoir containing a volume of molten metal sufficient to delay solidification of said molten metal in said runner while said piston continues advancing by said distance which injects additional molten metal into said die cavity to make up for any shrinkage of said part during solidification.

2. The apparatus of claim 1 wherein said chamber in said runner is generally spherical.

3. The apparatus of claim 2 wherein said means advancing said piston comprises means for continuing advancement of said piston, after said die cavity is filled, with a force which generates in said molten metal a pressure of less than about 5,000 psi.

4. The apparatus of claim 3 wherein said means advancing said piston comprises means for continuing advancement of said piston, after said die cavity is filled, with a force which generates in said molten metal a pressure less than about 1,000 psi.

5. The apparatus of claim 1 wherein said means advancing said piston comprises means for continuing advancement of said piston, after said die cavity is filled, with a force which generates in said molten metal a pressure less than about 5,000 psi.

6. The apparatus of claim 5 wherein said means advancing said piston comprises means for continuing advancement of said piston, after said die cavity is filled, with a force which generates in said molten metal a pressure of less than about 1,000 psi.

7. The apparatus of claim 1 wherein said piston is made of steel and has passage means therein for circulating a coolant therethrough.

8. A method for casting parts from metal in a cold-chamber die-casing machine having a shot cylinder with a piston which injects a charge of molten metal through a sprue cavity and a runner to fill a die cavity to form said part, said method comprising the steps of:

sizing said sprue cavity to a diameter about as great as and substantially concentric with said shot cylinder and a depth in front of said shot cylinder to form a biscuit extending from said shot sleeve into said sprue cavity having a volume sufficient to form a solidified cylindrical shell of metal thin enough such that after said piston is advanced to inject molten metal to fill said die cavity, said piston is advanced farther toward said sprue cavity to crush said solidified cylindrical shell of metal and inject additional molten metal into said die cavity to make up for shrinkage of molten metal during solidification; and providing a chamber forming a reservoir in said runner adjacent said die cavity, said chamber containing a volume of molten metal sufficient to delay solidification of said molten metal in said runner while said piston continues advancing to inject additional molten metal into said die cavity to make up for any shrinkage of said part during solidification.

9. The method of claim 8 wherein said piston is advanced farther with a force sufficient to generate a pressure in said molten metal of not more than about 5,000 psi while making up for shrinkage.

10. The method of claim 9 wherein said piston is advanced farther with a force sufficient to generate a pressure in said molten metal of not more than about 1,000 psi while making up for shrinkage.

11. Cold chamber die-casting apparatus for casting metal part, said apparatus comprising:

die means comprising a fixed die part and a moveable die part defining between them a die cavity in which said part is formed;

a shot cylinder connected to said die means and having a shot cylinder bore in which a charge of molten metal is received;

said die means also defining a sprue cavity communicating with said shot cylinder bore and a runner connecting said sprue cavity to said die cavity;

a piston reciprocally slidable in said shot cylinder bore;

means advancing said piston in said shot cylinder bore to inject said charge of molten metal through said sprue cavity and runner into said die cavity to fill said die cavity; and said runner defining a gate at said die cavity sized to restrict flow and generate a high injection velocity into said die cavity and having a chamber adjacent said gate forming a reservoir containing a volume of molten metal sufficient to delay solidification of said molten metal in said runner while said piston continues advancing to inject additional molten metal into said die cavity to make up for any shrinkage of said part during solidification.

12. The apparatus of claim 11 wherein said chamber in said runner is generally spherical.

13. The apparatus of claim 12 wherein said gate is generally circular.

* * * * *